US008701226B2

(12) United States Patent
Faucher et al.

(10) Patent No.: US 8,701,226 B2
(45) Date of Patent: Apr. 22, 2014

(54) CONDUCTIVE CONNECTION FOR TRACK-RIDING PATIENT HOISTS

(75) Inventors: Martin Faucher, Magog (CA); Michael Molinar, Eastman (CA); Michael Corriveau, St-Denis-de_Brompton (CA); Jocelyn Patry, Sherbrooke (CA)

(73) Assignee: Arjohuntleigh Magog Inc. (CA)

( * ) Notice: Subject to any disclaimer, the term of this patent is extended or adjusted under 35 U.S.C. 154(b) by 393 days.

(21) Appl. No.: 12/867,950

(22) PCT Filed: Feb. 4, 2009

(86) PCT No.: PCT/IB2009/005034

§ 371 (c)(1),
(2), (4) Date: Sep. 15, 2010

(87) PCT Pub. No.: WO2009/104096

PCT Pub. Date: Aug. 27, 2009

(65) Prior Publication Data

US 2011/0000015 A1 Jan. 6, 2011

Related U.S. Application Data

(60) Provisional application No. 61/029,503, filed on Feb. 18, 2008.

(51) Int. Cl.
*A61G 7/10* (2006.01)

(52) U.S. Cl.
USPC ..... 5/85.1; 5/83.1; 414/921

(58) Field of Classification Search
USPC ..... 5/81.1 R, 83.1, 85.1; 104/91, 94, 288, 104/295; 212/328, 331, 346; 414/560, 561, 414/921; 191/23 A, 33 R, 35, 50, 59.1, 72, 191/74; 105/149.2, 155
See application file for complete search history.

(56) References Cited

U.S. PATENT DOCUMENTS

| | | | | |
|---|---|---|---|---|
| 2,443,387 | A * | 6/1948 | Harris | 191/23 A |
| 3,646,613 | A * | 2/1972 | Matsumoto et al. | 104/295 |
| 3,820,469 | A | 6/1974 | Rikman et al. | |
| 3,848,714 | A * | 11/1974 | Claxton et al. | 191/33 R |
| 5,138,953 | A * | 8/1992 | Horcher et al. | 105/149.2 |
| 5,147,051 | A | 9/1992 | Liljedahl | |
| 6,711,759 | B1 | 3/2004 | Kluckhuhn | |
| 7,237,491 | B2 | 7/2007 | Faucher et al. | |
| 7,516,857 | B2 * | 4/2009 | Muller et al. | 212/271 |
| 7,850,026 | B2 * | 12/2010 | McKay | 212/315 |

FOREIGN PATENT DOCUMENTS

WO WO 88/09159 A1 12/1988

* cited by examiner

*Primary Examiner* — Robert G Santos
*Assistant Examiner* — Nicholas Polito
(74) *Attorney, Agent, or Firm* — Craig A. Fieschko, Esq.; DeWitt Ross & Stevens S.C.

(57) ABSTRACT

A patient hoist is provided on a trolley which tides along a track, with the hoist being powered by a conductor extending along the track. A contact carrier is loosely fit within the trolley, and it bears a contact which elastically biased against the track conductor, with die contact being in electrical communication with the hoist: The contact carrier is tree to laterally displace with respect to the trolley so that it (and its contact) follows the contour of the track, with the contact remaining in electrical communication with the track conductor.

23 Claims, 4 Drawing Sheets

CONDUCTIVE CONNECTION FOR TRACK-RIDING PATIENT HOISTS

FIELD OF THE INVENTION

This document concerns an invention relating generally to hoists which ride on ceiling-mounted or other tracks to various locations to lift or convey patients or equipment, and more specifically to hoists of this nature which require electric power supply at various locations along the track.

BACKGROUND OF THE INVENTION

Hoists which ride on ceiling-mounted or other tracks are commonly used in hospitals and other care centers, as well as in the homes of those with mobility impairments, to convey people and/or equipment to different areas (e.g., from a bed to a bathroom). Examples of such hoists are provided, for example, in U.S. Pat. No. 7,237,491 to Faucher et al., International (PCT) Patent Appln. Publication WO 88/09159, and in other patents cited in (and citing to) these references. Such hoists are usually electrically-powered, and they may ride on the tracks via manually-driven trolleys, or trolleys which are themselves electrically driven to assist in driving the hoists along their tracks. Power may be provided to the hoists via elongated flexible cables that follow the hoists along their tracks, but these can cause difficulties owing to the length of cable needed where the hoists are to travel long distances, and owing to the desire to avoid cable slack and dangling cable. Hoists have also been developed which are powered by rechargeable batteries, with the batteries being recharged when the hoist is placed at a docking position near the end of a track (or at any one of several docking positions along the track). These too pose difficulties in that users often forget to place the hoists back in their docking positions after use, leading to dead batteries and hoists which are inoperative until they are recharged (which can lead to hardships for their users). Some hoists have a feature wherein their trolleys automatically drive the hoists to a charging station when not in use, thereby better ensuring that their batteries remain charged. However, such "return-to-charger" features are sometimes thwarted when objects (such as curtains, IV equipment, monitors, etc.) obstruct the return paths of the hoists. Additionally, return-to-charger features cannot easily be implemented in "moving-track" systems such as the ones shown in U.S. Pat. No. 7,237,491, wherein the track on which the hoist rides itself rides on another track (e.g., a first track aligned along one direction is relocatable on a second track oriental perpendicularly from the first track). In such systems, the hoist can move in a variety of directions (e.g., about a plane), but it is difficult to devise an inexpensive and reliable arrangement for having both the hoist and the track on which it rides reliably return to a charging station.

Owing to the foregoing problems, there has long been interest in development of a hoist which receives (or is capable of receiving) power at all times, regardless of its position along the track, and without the need for umbilical cables, and which is suitable for use in moving-track systems. One possible solution that might be contemplated is to have the track (or a portion thereof) conduct power to the trolley, which could in turn power the hoist, in a manner similar to the way in which a "third rail" powers an electric train and the components therein. However, the arrangements used in trains and the like are not reliably and inexpensively reproducible on the scale of a hoist, since hoists use substantially smaller tracks (which tend to travel along paths having substantially sharper radii of curvature than train tracks and the like). A key difficulty is in maintaining a reliable conductive connection between the trolley and track, particularly when the trolley travels about a curve in the crack; at this time, the contacts between the trolley and track are more likely to disengage, causing loss of power to the trolley in hoist systems.

SUMMARY OF THE INVENTION

The invention, which is defined by the claims set forth at the end of this document, is directed to devices which at least partially alleviate the aforementioned problems. A basic understanding of some of the features of preferred versions of the devices can be attained from a review of the following brief summary of the invention, with more details being provided elsewhere in this document. To assist in the reader's understanding, the following review makes reference to the accompanying drawings of an exemplary preferred version of the devices (with these drawings being briefly reviewed in the "Brief Description of the Drawings" section following this Summary section of this document).

Initially referring to FIG. 1, a patient lift 100 includes a hoist 102 with an electrically-actuated lifting member 104 which is movable between raised and lowered states (with the lifting member 104 here being depicted as a harness bar, though slings, seats, baskets, or other lifting members are possible). A hoist trolley 106 is attached to the hoist 102, with the hoist trolley 106 riding along a track 108 to transport the hoist 102 to different locations. The track 108 has opposing spaced track sides 110 (see also FIG. 2), each of which has an elongated track floor 112 which is oriented at least substantially horizontally, and an elongated track wall 114 extending upwardly from the track floor 112. Preferably, each track side 110 bears a track conductor 116 which, as will be discussed below, is intended to communicate power to the hoist 102 to enable actuation of its lifting member 104. In the exemplary patient lift 100 shown in the drawings, the track conductors 116 are provided on the opposing edges of the track floors 112 of the track sides 110. At least a portion of the hoist trolley 106 rides between the track sides 110, with wheels, pinions, or other drive members allowing the hoist trolley 106 to roll or be driven along the track 108. The hoist trolley 106 then bears trolley contacts 118 (see FIG. 3) which are biased outwardly into contact with the track conductors 116, with the trolley contacts 118 being in electrical communication with the hoist 102. As a result, electrical power borne by the track conductors 116 is communicated to the trolley contacts 118 and in turn to the hoist 102.

The hoist trolley 106 has opposing right and left trolley sides 120 (with only the right Side being visible in FIG. 1), and a contact carrier channel 122 (best seen in FIG. 2, provided on an insert 124 received within the hoist trolley 106) extends between the right and left trolley sides 120. A contact carrier 126 is fit within the contact carrier channel 122, and the contact carrier 126 includes the trolley contacts 118 (FIG. 3) thereon so that the trolley contacts 118 extend outwardly from the opposing sides of the contact carrier 126. The contact carrier 125 is movable within the contact carrier channel 122 so mat it may move in at least one dimension with respect to the hoist trolley 106 and hoist 102, namely, in the lateral (rightward/leftward) direction. Preferably, the contact carrier channel 122 is dimensioned such that its bounds (inner perimeter) are at least slightly greater than the bounds (outer perimeter) of the contact carrier 126, so that the contact carrier 126 may also move at least vertically within the hoist trolley 106. When the hoist trolley 106 is installed to ride on the track 108 (see particularly FIG. 3), the contact carrier 126 is situated between the track sides 110 with the trolley contacts 118 extending into contact with the track conductors 116. The trolley contacts 118 are in conductive communication with contact connectors 128, which can in turn be connected to hoist connectors 130 (see FIG. 1) which communicate power to the hoist 102. Thus, power supplied to the track conductors 116 (see FIG. 3) is in turn communicated to the trolley contacts 118, and then in turn to the contact connectors 128, the hoist connectors 130 (FIG. 1), and the hoist 102, whereby a hoist 102 riding along the track 108 may receive power at various locations along the track 108. The contact carrier 126, which is only restrained to the hoist trolley 106 and hoist 102 by the inner bounds of the contact carrier channel 122 (and by the flexible connection between the contact connectors 128 and hoist connectors 130, see FIG. 1), is therefore urged along the track sides lift by the hoist trolley 106, but is displaceable with respect to the hoist trolley 106 as the hoist trolley 106 rides between the track sides 110 so that the trolley contacts 118 may always remain in conductive communication with the track conductors 116. This conductive communication is also assisted by biasing the trolley contacts 118 elastically outwardly from the contact carrier 126 sides, as by the springs 132 shown in FIGS. 2 and 3, so that the trolley contacts 118 remain in contact with the track conductors 116. Because the contact carrier 126 displaces between the track sides 110 to follow their contours (and since the trolley contacts 118 are elastically biased into contact with the track conductors 116), the contact problems that may arise as the hoist trolley 106 and hoist 102 travel about the track 108 are at least substantially avoided.

Other useful features may be implemented to maintain and enhance conductive communication between the trolley contacts 118 and the track conductors 116. As one example, best seen in FIGS. 2-3, each track conductor 116 may be situated within a conductor groove 134 in its track side 110, with each trolley contact 118 extending within a conductor groove 134 to contact one of the track conductors 116. The track conductors 116 art thereby guided by the surfaces of the conductor grooves 134 to remain in contact with the track conductors 116.

As another example, upper contact covers 136 (see FIGS. 2-3) may be provided to extend outwardly from the contact carrier 126 above the trolley contacts 118, with the upper contact cover 136 riding above and closely adjacent to the track sides 110 so that the track sides 110 urge the upper contact covers 136 (and thus the contact carrier 126 and trolley contacts 118) into proper conductive alignment as the hoist trolley 106 and contact carrier 126 travel along the track 108. Each upper contact cover 136 preferably includes a first upper contact cover portion 138 extending outwardly from the hoist trolley 106 above and closely adjacent to one of track floors 112, and a second upper contact cover portion 140 extending upwardly from the first upper contact cover portion 138 closely adjacent to one of the track walls 114. The second upper contact cover portion 140 usefully helps to guide the contact carrier 126 between the track sides 110, while the first upper contact cover portion 138 assists in preventing detritus from falling between the trolley contacts 118 and track conductors 116. Lower contact covers 142 can also be provided to extend outwardly from the contact carrier 126 sides below and closely adjacent to the track sides 110 to provide further protection against foreign matter, as well as protection against inadvertent contact of the conductive components by personnel servicing the hoist 102 and hoist trolley 106.

To assist in easy maintenance of the track conductors 116, they are preferably provided as strips which are readily installable and removable within the track sides 110. Thus, as best seen in FIGS. 2-3, each track conductor 116 may bear a protruding connection tongue 144, and each track side 110 may bear a connection groove 146, with the connection tongue 144 being removably fit within the connection groove 146.

The foregoing arrangements may be usefully implemented in both fixed-track systems (as in FIG. 1) and in moving-track systems (as in FIG. 4). Looking to the exemplary moving-track system of FIG. 4, the hoist 102 and its hoist trolley 106 may electrically communicate with the (lower) track 108 as described above, and the lower track 108 may then bear a track trolley 148 which rides on an upper track 150. The upper track 150 may then include an upper track conductor 152 (e.g., track conductors similar to those discussed previously) in electrical communication with the track conductors 116 of the lower track 108. One aid of the lower track 108 bears a stationary contact carrier 154 in conductive communication with the track conductors 116 of the lower track 108, with leads from this stationary contact carrier 154 leading to a mobile contact carrier 156 within the track trolley 148 (this mobile contact carrier 156 being shown in FIG. 4 in a position "exploded" downwardly from the track trolley). The upper track 150 then has a stationary contact carrier 158 leading to a power supply (not shown). Thus, the power supply supplies power in turn to the stationary contact carrier 158 of the upper track 150, the track conductor(s) 152 of the upper track 150, the mobile contact carrier 156 of the track trolley 148, the stationary contact carrier 154 of the lower track 108, the track conductors 116 of the lower track 108, and finally the mobile contact carrier 126 of the hoist trolley 106, and thus to the hoist 102.

Further versions, features, and advantages of the invention will be apparent from the remainder of this document in conjunction with the associated drawings.

DETAILED DESCRIPTION OF PREFERRED VERSIONS OF THE INVENTION

Figure 1:
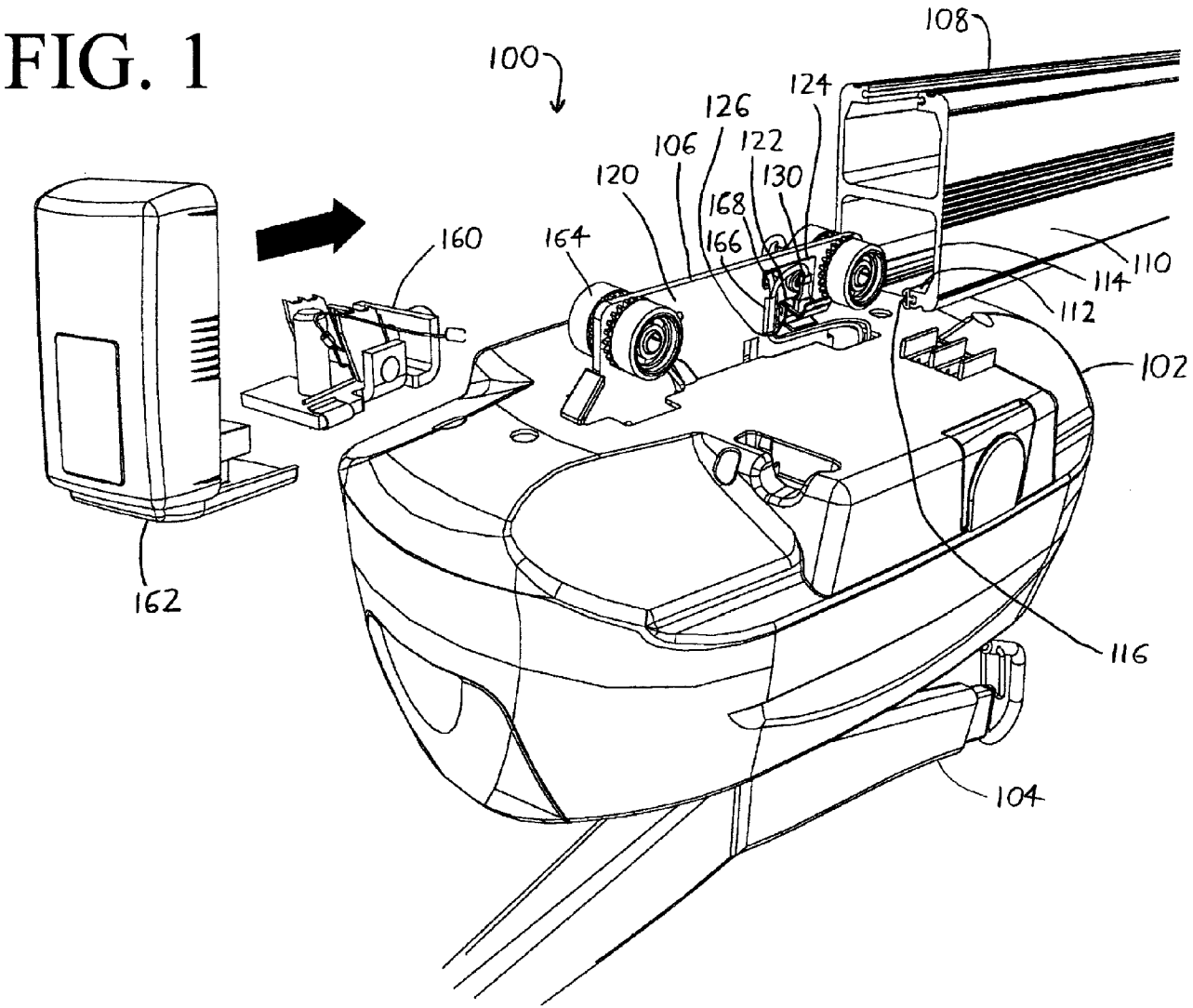
FIG. 1 is a partially exploded perspective view of a patient lift 100 including a hoist 102 having a hoist trolley 106 which travels along the track 108 (the hoist trolley 106 being shown ready for installation within the track 108), with a stopping mechanism 160 for the hoist trolley 106 and an endcap 162 also being shown spaced away from the track 108 wherein they are installed.

Expanding on the discussion above, the hoist 102 and track 108 illustrated throughout the drawings are adapted from the KWIKtrack and hoist system of BHM Medical Inc. (Magog, QC, Canada), which is available with a number of different track and hoist configurations. The exemplary track 108 illustrated throughout the drawings is configured similarly to a pair of C-channels which are joined with their mouths facing in opposing directions, as best seen in FIG. 3. Usefully, some versions of the KWIKtrack track, already include the connection grooves 146, which can be used to receive the connection tongues 144 of the track conductors 116 as previously described. Thus, the track 148 is readily constructed by simply installing the track conductors 116 therein. Once the track conductors 116 are installed within the track 108, the hoist trolley 106 may be installed on the track 108 by slipping the hoist trolley 106 between the track sides 110 (as illustrated in FIG. 1). At the same time, the trolley contacts 118 may be biased inwardly against the force of the springs 132 (best in seen in FIGS. 2-3) so that the trolley contacts 118 fit within the conductor grooves 134, and so that the upper contact covers 136 and lower contact covers 142 are situated on the opposing upper and lower sides of the track floor 112. FIG. 1 also illustrates a stopping mechanism 160 which may be fit within the track sides 110 at the end of the track 108, with the stopping mechanism 160 bearing a contact switch or other means for detecting when the hoist trolley 106 reaches or approaches the end of the track 108 (and thereby triggers the stopping mechanism 160). An end cap 162 which may be fixed to the end of the track 108 to close it is also shown.

The hoist trolley 106 illustrated in FIG. 1 is shown as being of a type wherein four wheels 164 drive the hoist trolley 106 along the track 108, with the wheels 164 being driven by an appropriate drive situated on or within the hoist 102 to have wheels 164 roll along the track floor 112. However, it should be understood that any number of drive wheels 164 (or pinions or other drive mechanisms) could be used instead, and/or that these drive mechanisms might engage one or more of the track walls 114 rather than one or both sides of the track floors 112. It is also possible that the hoist trolley might be driven along the track 108 by a belt, cable, or other drive rather than being driven by the wheels 164.

Figure 2:
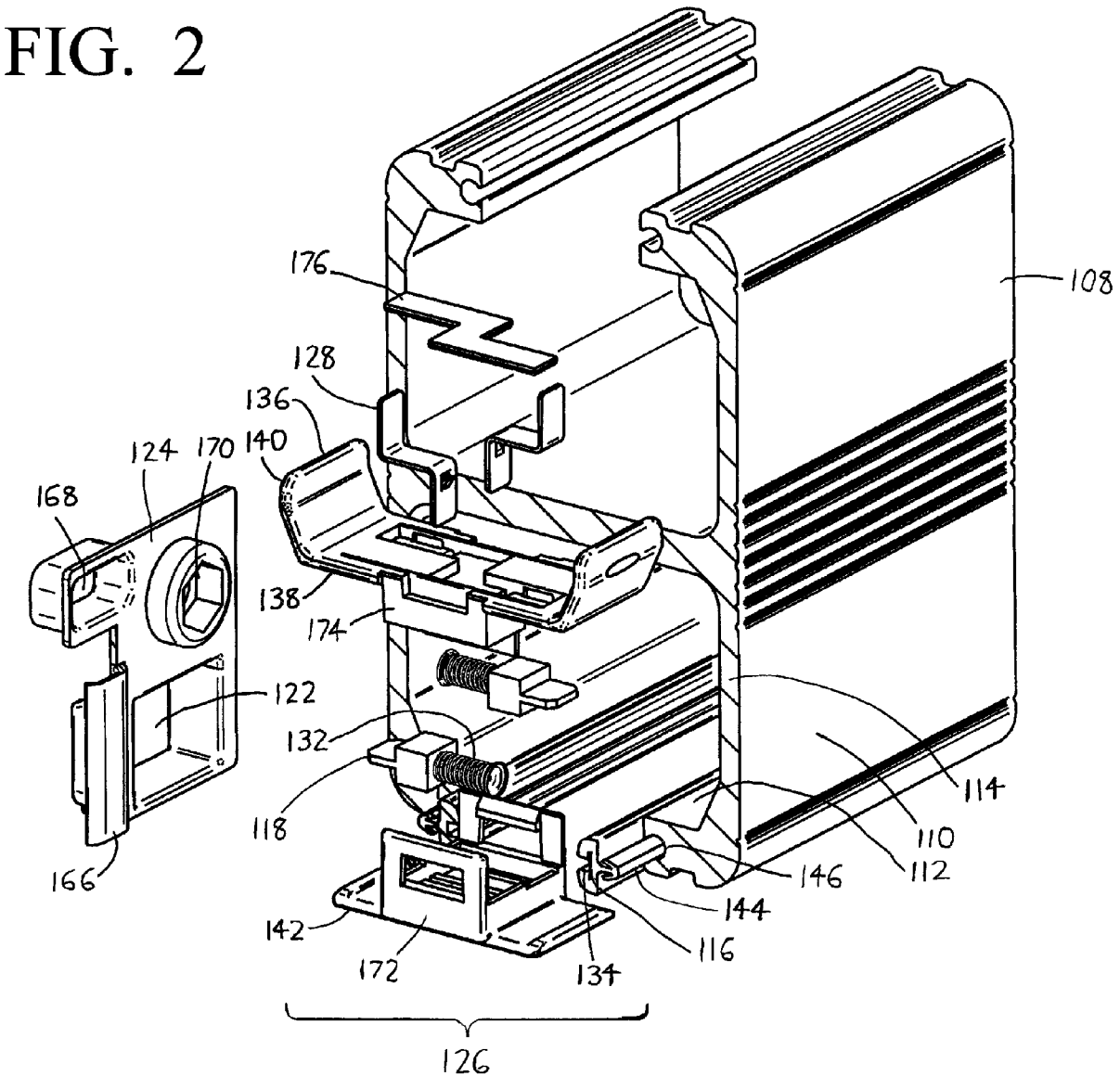
FIG. 2 is an exploded perspective view of a section of the track 108 (and its track conductors 116) shown with the insert 124 of the hoist trolley 106, and with the contact carrier 126 shown disassembled into its component lower carrier portion 172, upper carrier portion 174, trolley contacts 118 (and biasing springs 132), contact connectors 128, and carrier cover 176.
Figure 3:
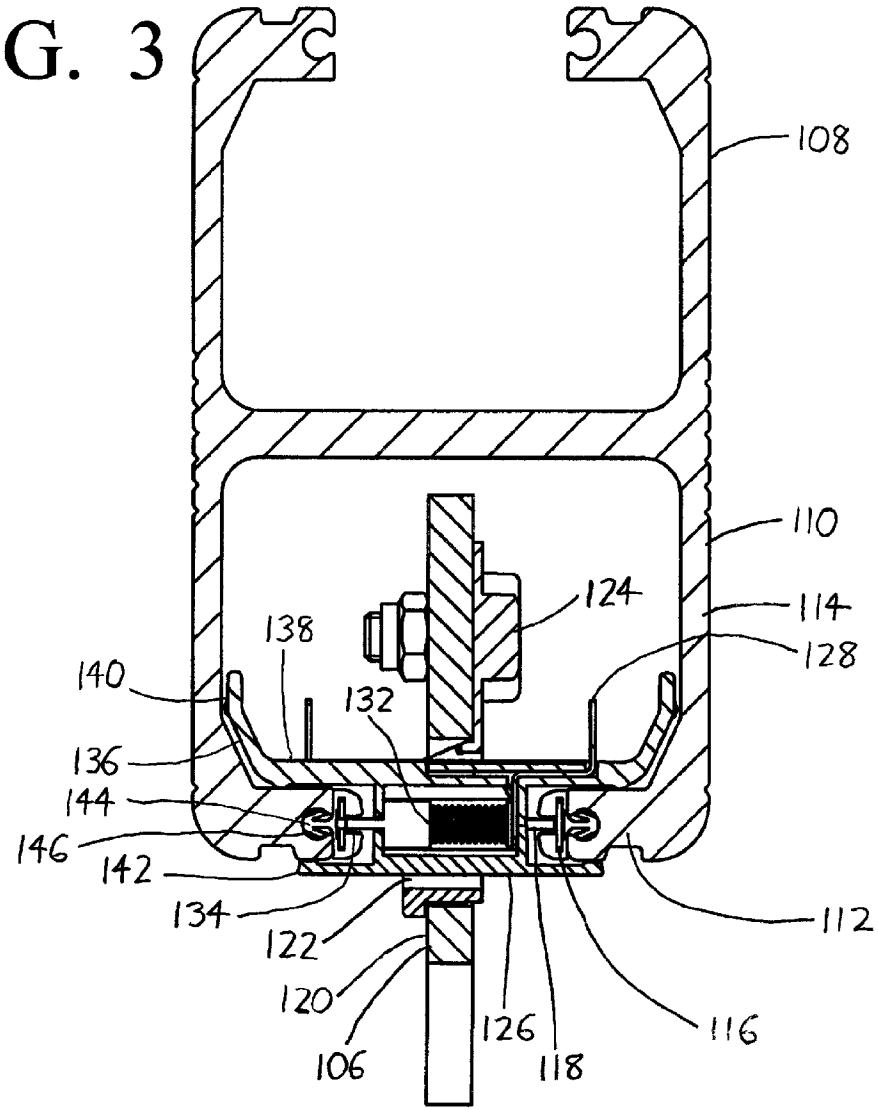
FIG. 3 is an elevational view of the track 108 (and its track conductors 116) with the insert 124 and contact carrier 126 installed, shown sectioned so that the contact between the track conductors 116 and trolley contacts 118, and the complementary shaping of the upper contact covers 136 and the interior of the track 108, are visible.

Looking particularly to FIG. 2, the contact carrier channel 122 is provided within the insert 124, which in turn fits into the hoist trolley 106 (as seen in FIG. 1). As FIG. 1 illustrates, the insert 124 bears a clip 166 for restraining the leads extending from the hoist 102 to the hoist connectors 130, and for allowing one of these leads to pass from one side of the hoist trolley 106 to the other via a passage 168. A bolt hole 170 (see FIG. 2) allows insertion of a fastener to affix the insert 124 to the hoist trolley 106. The insert 124 is not required, and the contact carrier channel 122 might instead be situated directly within the hoist trolley 106, but use of the insert 124 can assist in manufacturing, installation, and maintenance.

As illustrated in FIG. 2, the contact carrier 126 is formed in several parts which are readily fit together to construct the contact carrier 126: a lower carrier portion 172 which bears the lower contact covers 142, and which slidably receives the trolley contacts 118 and their springs 132; an upper carrier portion 174 which also slidably receives the trolley contacts 118 therein, with the springs 132 biasing the trolley contacts 118 outwardly through apertures defined between the lower carrier portion 172 and upper carrier portion 174; the contact connectors 128, which extend upwardly from a conductive connection with the springs 132 and trolley contacts 118 so that the hoist connectors 130 (FIG. 1) may be fit thereover; and a carrier cover 176 which snap-fits into the upper carrier portion 174 to better prevent detritus from falling into the contact carrier 126. The assembled contact carrier 126 may then be seen (in cross-section) installed within the track 108 in FIG. 3. The trolley contacts 118 may be formed similarly to brushes found in DC motors and similar devices, with preferred versions of the invention using copper-graphite trolley contacts 118 in communication with copper contact connectors 128 and springs 132. The springs 132 need not be conductive, and the trolley contacts 118 may communicate with the contact connectors 128 via wires.

Figure 4:
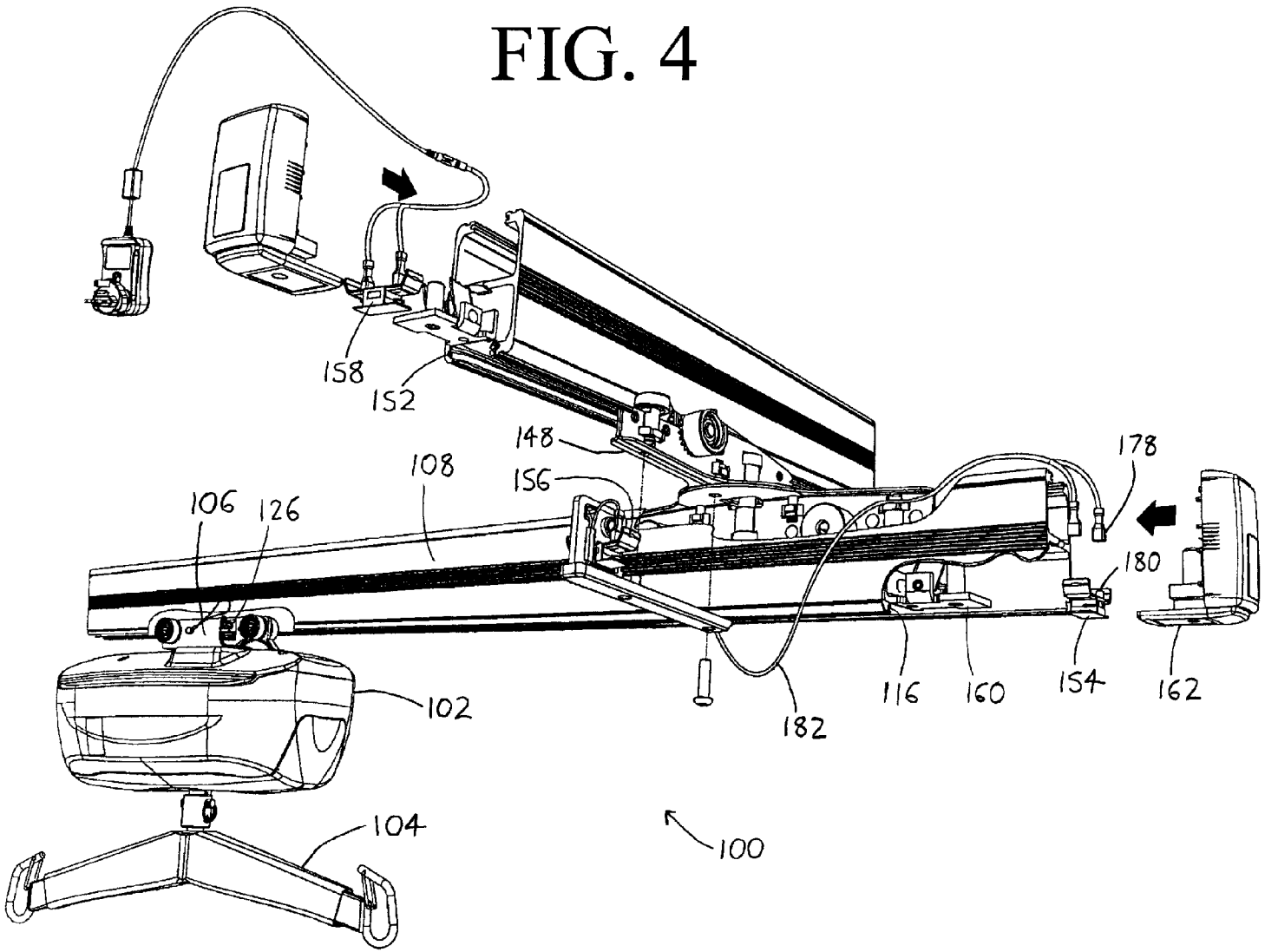
FIG. 4 is a partially exploded perspective view of the patient lift 100 of FIG. 1 installed in a moving-track system wherein the (lower) track 108 is provided on a track trolley 148, with the track trolley traveling along an upper track 150, so that the hoist 102 can move in two dimensions (in both the direction of the lower track 108 and the direction of the upper track 150).

Turning to FIG. 4, the hoist 102 (with its associated hoist trolley 106 and contact carrier 126) fides along the lower track 108 in the manner described above. As previously discussed, the track conductors 116 of the lower track 108 are supplied with power from a stationary contact carrier 154 situated near the end of the track 108, between the stopping mechanism 160 and the endcap 162. Lead connectors 178 fit over the contact connectors 180 of the stationary contact carrier 154 so chat the stationary contact carrier 154 may receive power via leads 182 from the mobile contact carrier 156 within the track trolley 148. The track trolley 148 functions to drive the connected lower track 108 along the upper track 150 similar to the manner in which the hoist trolley 106 drives the hoist 102 along the lower track 108. The contact carrier 156 of the track trolley 148 communicates with the track conductors 152 in the upper track to carry power from a power source, with the power source communicating with the upper track conductors 152 via stationary contact carrier 158.

The stationary contact carrier 154 of the lower track 108 is shown communicating with the trolley contact carrier 156 via leads 182 since it is contemplated that the track trolley 148 will only travel across the upper track 150, with the lower track 108 remaining fixed to the track trolley 148 in the position shown. However, it is also possible to have the lower track 108 travel along the track trolley 148, so long as the lower portion of the track trolley 148 (the portion situated within the upper channel of the track 108) is appropriately configured (e.g., if configured similarly to the hoist trolley 106). In this case, it would be inconvenient to include the leads 182 since these would serve as an umbilical tether which restricts the movement of the lower track 108 on the lower portion of the track trolley 148. It would instead be preferable to have the leads 182 extend from the stationary contact carrier 154 in the lower channel of the lower track 108 to a similar stationary contact carrier situated in the upper channel of the lower track 108, so that power is communicated between the track conductors 116 of the lower channel of the lower crack 108 to the track conductors (not shown) of the upper channel of the lower track 108. A contact carrier on the lower portion of the track trolley 148 (the portion riding within the upper channel of the lower track 108) can then be provided in conductive communication with the track trolley contact carrier 156. Thus, power can be communicated from the power source, to the upper track stationary contact carrier 158, to the upper track conductors 152, to the upper track trolley Contact carrier 156, to the lower track trolley contact carrier (not shown), to the track conductors (not shown) in the upper channel of the track 108 and to their stationary contact carrier (not shown), then to the lower stationary contact carrier 154 provided in the lower channel of the track 108, and finally to the track conductors 116 of the lower track 108, the hoist trolley 106, and the hoist 102.

The invention is usable to provide power to the hoist 102 regardless of the hoist's location along a track 108 (or tracks 108/150), whether for the purpose of charging batteries within the hoist 102 or for simply directly powering the hoist 102 (and/or any drive system for driving the hoist trolley 106 along the track 108).

It is notable that owing to the use of a contact connection which engages track conductors 116 regardless of variations in the relative positions of the track 108 and the hoist trolley 106, and/or regardless of variations in the spacing of the track sides 110, the invention may be usable with flexible or articulated tracks—that is, tracks which are bendable so that they may be oriented as desired. Consider, for example, a track 108 made of semi-flexible plastic material rather than metal or rigid plastic, whereby the track 108 may be curved as needed and affixed to a ceiling or other support. Bending such a track 108 would tend to cause variations in the spacing between the track sides 110 (and thus variations in the location of the track conductors 116), thereby making it difficult to ensure conductive contact as the hoist trolley 106 travels along the track 108. However, the exemplary version of the invention described above can accommodate such variations since its contact carrier 126 will move to fit track variations, and its elastically-biased contacts 118 will work to maintain contact with the track conductors 116.

The various components described above may be made of any suitable materials. Preferably, the contact carrier 126 is made of plastic (for insulating purposes), whereas the hoist trolley 106 and track 108 are made of metal for strength and durability. The track conductors 116 are then preferably formed of conductive strips coextruded within plastic sheaths, with these sheaths bearing the connection tongues 144 for attachment within the connection grooves 146 in the track sides 110 so that the track conductors 116 are insulated from the (metal) track 108 and its track sides 110. While not preferred, it is possible for a metal track 108 to serve as one of the track conductors 116.

It should be understood that the contact arrangements discussed above are merely exemplary, and other arrangements are possible. For example, the track conductors 116 might be provided on one of the track sides 110—e.g., with one situated below the other—and the trolley contacts 118 might then be biased outwardly from one side of the contact carrier 126 to conductively engage the track conductors 116. The trolley contacts 118 can also be aligned to engage track conductors 116 situated on horizontal or vertical surfaces of the track sides 110, either within or outside the channels formed within the track 108. In any case, the displaceable contact carrier 126, and/or the spring-biased trolley contacts 118, can assist in maintaining conductive communication between the trolley 106 and the track conductors 116.

It should also be understood that the versions of the invention described above are merely exemplary, and the invention is not intended to be limited to these versions. The invention may assume forms which have appearances, components, uses, and functions which are vastly different than those noted above; for example, the invention might be utilized with tracks having configurations different from the one shown. As another example, the invention might be implemented in the patient lifts of the patents and publications noted at the outset of this document or features of those patient lifts might be incorporated into versions of this invention. Thus, the scope of rights to the invention is limited only by the claims set out below, with the invention encompassing all different versions that fall literally or equivalently within the scope of these claims.

What is claimed is:

1. A patient lift including:

a. a hoist, the hoist including an electrically-actuated lifting member movable between raised and lowered states;

b. a hoist trolley attached to the hoist, the hoist trolley including;

(1) opposing trolley sides oriented toward the track sides, and (2) a contact carrier fit within the hoist trolley to laterally extend between the trolley sides, with the contact carrier:

i. being laterally displaceable within the hoist trolley, and ii. including trolley contacts situated thereon;

c. a track having opposing spaced track sides;

(1) wherein at least a portion of the hoist trolley rides between the track sides, and (2) each bearing a track conductor;

wherein the trolley contacts are biased outwardly from the hoist trolley into contact with the track conductors, the trolley contacts being in electrical communication with the hoist, whereby electricity borne by the track conductors is communicated to the trolley contacts and in turn to the hoist.

2. The patient lift of claim 1 wherein the contact carrier rests within a contact carrier channel extending between opposing sides of the hoist trolley, wherein the bounds of the contact carrier within the contact carrier channel are smaller than the bounds of the contact carrier channel, whereby the contact carrier is displaceably fit within the contact carrier channel.

3. The patient lift of claim 1 further including upper contact covers extending outwardly from the hoist trolley above the trolley contacts, wherein the upper contact cover rides above and closely adjacent to the track sides.

4. The patient lift of claim 3 wherein:

a. each track side includes:

(1) an elongated track floor, the floor being oriented at least substantially horizontally, and (2) an elongated track wall extending upwardly from the track floor, b. each upper contact cover includes:

(1) a first upper contact cover portion extending outwardly from the hoist trolley above and closely adjacent to one of the track floors, and (2) a second upper contact cover portion extending upwardly from the first upper contact cover portion closely adjacent to one of the track walls.

5. The patient lift of claim 3 further including lower contact covers extending outwardly from the hoist trolley below the trolley contacts, wherein each lower contact cover rides below and closely adjacent to one of the track floors.

6. The patient lift of claim 1:

a. wherein the track is a lower track;

b. further including an upper track whereupon the lower track rides, the upper track bearing an upper track conductor in electrical communication with the track conductors of the lower track.

7. The patient lift of claim 1 wherein:

a. each track conductor is situated within a conductor groove in its track side, and b. each trolley contact extends within a conductor groove to contact one of the track conductors.

8. The patient lift of claim 1 wherein:

a. each track conductor bears a protruding connection tongue, and b. each track side bears a connection groove, with the connection tongue being removably fit within the connection groove.

9. The patient lift of claim 1 wherein:

a. each track side includes:

(1) an elongated track floor, the floor being oriented at least substantially horizontally, and (2) an elongated track wall extending upwardly from the track floor, b. the trolley contacts extend outwardly from the contact carrier onto track conductors situated on the track floor.

10. A patient lift including:

a. a hoist, the hoist including an electrically-actuated lifting member movable between raised and lowered states;

b. a hoist trolley attached to the hoist, the hoist trolley having:

(1) opposing right and left trolley sides;

(2) a contact carrier channel extending between the right and left trolley sides;

(3) a contact carrier fit within the contact carrier channel, the contact carrier including a trolley contact extending therefrom, wherein:

(a) the trolley contact is in electrical communication with the hoist, and (b) the contact carrier is translatable rightwardly and leftwardly within the contact carrier channel.

11. The patient lift of claim 10:

a. further including a track:

(1) whereupon the hoist trolley rides, and (2) having opposing spaced track sides, at least one track side bearing a track conductor, b. wherein the contact carrier rides between the track sides with the trolley contact in contact with the track conductor.

12. The patient lift of claim 11:

a. wherein the track is a lower track;

b. further including an upper track whereupon the lower track rides, the upper track bearing an upper track conductor in electrical communication with the track conductor of the lower track.

13. The patient lift of claim 10 wherein the contact carrier is also translatable upwardly and downwardly within the contact carrier channel.

14. The patient lift of claim 10 wherein the trolley contact is elastically biased outwardly from the contact carrier.

15. The patient lift of claim 10:

a. wherein the contact carrier includes:

(1) upper contact covers extending outwardly therefrom above the trolley contact, (2) lower contact covers extending outwardly therefrom below the trolley contact, b. further including a track:

(1) whereupon the hoist trolley rides, and (2) having opposing spaced track sides, at least one track side bearing a crack conductor, wherein, (a) the upper contact covers ride above and closely adjacent to the track sides, and (b) the lower contact covers ride below and closely adjacent to the track sides.

16. A patient lift including:

a. a hoist, the hoist including an electrically-actuated lifting member movable between raised and lowered states;

b. a track having apposing spaced track sides, each bearing a track conductor, c. a contact carrier having opposing contact carrier sides, each contact carrier side including:

(1) an upper contact cover extending outwardly from the contact carrier side, wherein the upper contact cover tides above and closely adjacent to one of the track sides;

(2) a lower contact cover extending outwardly from the contact carrier side, wherein the lower contact cover tides below and closely adjacent to one of the track sides;

(3) a trolley contact extending outwardly from the contact carrier side, the trolley contact:

(a) being situated below the upper contact cover and above the lower contact cover, and (b) being connected in electrical communication between the hoist and one of the track conductors, wherein the contact carrier sides are:

i. restrained to, but ii. displaceable in at least one dimension with respect to, the hoist.

17. The patient lift of claim 16 further including a trolley:

a. affixed to the hoist, b. riding between the opposing track sides, and c. having the contact carrier displaceably mounted therein.

18. The patient lift of claim 17 wherein the contact carrier is both horizontally and vertically displaceable with respect to the trolley.

19. The patient lift of claim 16 wherein the trolley contacts are elastically biased outwardly from the contact carrier sides.

20. The patient lift of claim 16 wherein:

a. each track side includes:

(1) an elongated track floor, the floor being oriented at least substantially horizontally, and (2) an elongated track wall extending upwardly from the track floor, b. each upper contact cover includes:

(1) a first upper contact cover portion extending outwardly from the hoist trolley above and closely adjacent to one of track floors, and (2) a second upper contact cover portion extending upwardly from the first upper contact cover portion closely adjacent to one of the track walls.

21. The patient lift of claim 16:

a. wherein the track is a lower track;

b. further including an upper track whereupon the lower track rides, the upper track bearing an upper track conductor in electrical communication with the track conductors of the lower track.

22. The patient lift of claim 16 wherein:

a. each track conductor is situated within a conductor groove in its track side, and b. each trolley contact extends within a conductor groove to contact one of the track conductors.

23. The patient lift of claim 16 wherein:

a. each track side includes:

(1) an elongated track floor, the floor being oriented at least substantially horizontally, and (2) an elongated track wall extending upwardly from the track floor, b. the trolley contacts extend outwardly from the contact carrier sides onto track conductors situated on the track floor.

* * * * *